United States Patent [19]

Kurachi et al.

[11] Patent Number: 5,006,689

[45] **Date of Patent: * Apr. 9, 1991**

[54] VACUUM INSULATED STORAGE TYPE ELECTRIC WATER HEATER HAVING AN EXTERNAL BUBBLE PUMP HEATING UNIT

[75] Inventors: Yasuhiko Kurachi, Aichi; Kazumi Mori, Okazaki; Hisao Koizumi, Zushi, all of Japan

[73] Assignees: Chubu Electric Power Company Inc., Nagoya; Kabushiki Kaisha Toshiba, Kawasaki, both of Japan

[ * ] Notice: The portion of the term of this patent subsequent to Sep. 25, 2007 has been disclaimed.

[21] Appl. No.: 247,375

[22] Filed: Sep. 21, 1988

[30] Foreign Application Priority Data

Sep. 21, 1987 [JP] Japan ..... 62-236858

[51] Int. Cl.[5] ..... H05B 1/02; F24J 2/00; F24H 1/18; F24H 1/10

[52] U.S. Cl. ..... 392/450; 122/494; 126/362; 417/208; 392/462; 392/480; 392/441

[58] Field of Search ..... 219/310, 312, 314, 316, 219/301, 297; 220/425; 126/362; 122/494; 417/208, 209

[56] References Cited

U.S. PATENT DOCUMENTS

| | | | |
|---|---|---|---|
| 970,095 | 9/1910 | McPheeters | 220/425 |
| 978,808 | 12/1910 | Ayer | 219/297 X |
| 1,223,674 | 4/1917 | Dearing | 219/310 X |
| 1,439,577 | 12/1922 | Pominville | 219/307 |
| 1,526,204 | 2/1925 | Campbell | 219/312 X |
| 2,151,854 | 3/1939 | Knapp | 219/314 |
| 2,233,050 | 2/1941 | Groeniger | 126/362 |
| 2,303,382 | 12/1942 | Newhouse | 126/362 U X |
| 2,519,920 | 8/1950 | Miner | 126/326 X |
| 2,544,927 | 3/1951 | Knapp | 219/314 X |
| 3,247,359 | 4/1966 | Feld | 219/301 X |
| 3,400,246 | 9/1968 | Zob | 219/297 |
| 4,698,456 | 10/1987 | Hamacher | 174/18 X |
| 4,818,845 | 4/1989 | Koizumi et al. | 219/314 |

FOREIGN PATENT DOCUMENTS

| | | | |
|---|---|---|---|
| 579942 | 7/1959 | Canada | 219/306 |
| 2641601 | 3/1978 | Fed. Rep. of Germany | 219/297 |
| 2950328 | 6/1981 | Fed. Rep. of Germany | 219/297 |
| 58-26958 | 2/1983 | Japan | 126/361 |
| 483529 | 4/1938 | United Kingdom | 122/494 |

*Primary Examiner*—Anthony Bartis

*Attorney, Agent, or Firm*—Oblon, Spivak, McClelland, Maier & Neustadt

[57] ABSTRACT

A hot water boiling apparatus includes a hot water storage tank. The storage tank has an inner tank storing water therein, an outer tank surrounding the inner tank, and a vacuum heat insulation layer defined between the inner and outer tanks and surrounding the inner tank. A electrically heated bubble pump unit is arranged outside the storage tank and used for drawing water from the inner tank through a water supply port formed at the bottom of the inner tank and, after heating the water, supplying it into the inner tank through a hot water supply port formed at the top of the inner tank. First and second connecting pipe respectively connect the bubble pump unit to the top and bottom water supply ports of the inner tank. The portions of the connecting pipes extending through the vacuum insulation space are oriented horizontally to minimize convection heat losses. The portion of the connecting pipe which passes through the vacuum heat insulation space is oriented horizontally.

7 Claims, 6 Drawing Sheets

VACUUM INSULATED STORAGE-TYPE ELECTRIC WATER HEATER HAVING AN EXTERNAL BUBBLE PUMP HEATING UNIT

BACKGROUND OF THE INVENTION

1. Field of the Invention

This invention relates to a hot water boiling apparatus of a storage type, using an electric heater as its heat source.

2. Description of the Related Art

Hot water boiling apparatuses using an electric heater as its heat source are classified into the instantaneous type and the storage type. The instantaneous type is constructed such that water is heated instantaneously to a certain temperature by the use of a large-capacity electric heater to supply hot water. The storage type is constructed such that hot water at a fixed temperature is previously stored in a hot water storage tank and the hot water is supplied when necessary. With an instantaneous type boiling apparatus, a sufficient amount of hot water cannot be supplied unless an electric heater with a capacity as large as 5 to 20 kw is used. For this reason, in the general households, storage type boiling apparatus are used exclusively.

Normally, storage type hot water boiling apparatus have a hot water storage tank, the outer surface of which is covered with a heat insulating material such as glass wool. The bottom of the storage tank is connected with a water supply pipe. The top of the tank is connected through a hot water supply pipe to a tap. A sheath-type electric heater is located at the bottom of the inside of the hot water storage tank. The whole water in the storage tank is kept heated to 80° C., for example, by supplying power to the electric heater and hot water is taken out through the hot water supply pipe when necessary. As for the method of producing water when a hot water boiling system for houses is composed using such a hot water supply, there are two methods: the centralized method in which a single large hot water boiling apparatus supplies to a number of places and the decentralized method in which small hot water boiling apparatuses are installed at the respective places of use. The centralized method has a problem that cold water comes out for a while due to cooling of the pipe after the tap is opened. Hence, the decentralized method is currently finding growing use.

When a conventional hot water boiling apparatus is reduced simply in size and used in a decentralized system, however, there is a problem as follows. In the decentralized method, the amount of hot water consumption at each place of use is necessarily small. It happens therefore, the heat loss due to radiation from the hot water storage tank is greater than the heat quantity of hot water consumed by actual use of hot water. To take an example, suppose a hot water storage tank 250 mm in inner diameter and 400 mm high, with a volume of 19.6 liters and a surface area of 0.412 m. Also suppose that the outer surface of the hot storage tank is covered with glass wool 25 mm thick and the head conductivity of glass wool is 0.035 kcal/m$^2$° C. h. Then, the heat loss through the heat insulating material is as follows. If the hot water temperature in the storage tank is 85° C. and the ambient temperature is 15° C., the heat loss Hl (kcal/h) is 40.38 (kcal/h). That is to say, heat loss a day is 1.13 kwh. If the heat loss is calculated in terms of amount of hot water, 20 liters of 68° C. hot water is wasted a day assuming that the temperature of water supplied is 20° C. A possible solution to this problem is to use a hot water storage tank of the vacuum heat insulation type excellent in diabatic performance. To install an electric heater in the hot water storage tank, however, it is necessary to provide a heater insertion passageway that passes through the vacuum heat insulation space. This not only increases the production cost of hot water storage tanks but causes heat loss through the heater-inserted portion of the storage tank, thus considerably reducing the effects of use of a vacuum heat insulation type of hot water storage tank. With a hot water boiling apparatus having an electric heater installed in the hot water storage tank, when power is supplied to the electric heater under the condition that, for example, hot water of 80° C. remains in the upper one third of the tank and water of 10° C. is present in the lower two thirds of the tank, as the electric heater begins to heat the water, thermal convection takes place, causing the whole water in the tank to be stirred. As a result, the temperature of the whole area in the tank falls uniformly to 33° C. for a time. Therefore, it is impossible to instantly supply hot water at an adequate temperature. Thus, conventional hot water boiling apparatuses have difficulty in quickly responding to the need.

As described above, if an attempt is made to use conventional hot water boiling apparatuses in a decentralized hot water supply system by reducing their size, a great heat loss can occur through the outer surfaces of the hot water storage tanks. In addition, an unfavorable phenomenon peculiar to the natural convection heating method takes place, which causes difficulty in quick response to demand.

SUMMARY OF THE INVENTION

This invention has been made in consideration of the above situation and has its object to provide a hot water boiling apparatus which sufficiently reduces heat loss from the hot water storage tank and can quickly supply hot water at an adequate temperature.

In order to achieve the above object, a hot water boiling apparatus according to this invention comprises a hot water storage tank including an inner tank adapted to store water therein and having a top wall, and an outer tank enclosing the inner tank. A vacuum heat insulation space is defined between the inner and outer tanks and substantially completely surrounds the inner tank. A hot water supply pipe is provided for guiding the water from an upper portion of the inner tank to the outside of the hot water tank. The supply pipe has an end portion connected to the top wall of the inner tank and passing through the vacuum insulation space and the outer tank air-tightly. The supply pipe has an insulating portion located in the vacuum insulation space and extending substantially horizontally through the vacuum space to the outer tank. A water supply means is provided for supplying a lower portion of the inner tank with water. Also provided is a flow-type water heating means arranged external of the water storage tank in flow communication with the water storage tank, for drawing the stored water from the lower portion of the inner tank and, after heating the water, returning the heated water into the upper portion of the inner tank. The heating means includes a connecting pipe which introduces the heated water into the inner tank and has an end portion connected to the top wall of the inner tank and passing through the insulation space and the outer tank air-tightly. The connecting pipe has an insulation portion located in the vacuum insulation space and extending substantially horizontally through the vacuum space to the outer tank.

According to another aspect of the invention, a hot water boiling apparatus includes a hot water storage tank including an inner tank adapted to store water therein, and an outer tank enclosing the inner tank. A vacuum heat insulation space is defined between the inner and outer tanks and surrounding the inner tank. A hot water supply pipe is provided for guiding the water from an upper portion of the inner tank to the outside of the hot water tank. Water supply means are provided for supplying a lower portion of the inner tank with water. Also provided are bubble pump means arranged external of the hot water storage tank, for feeding hot water into the upper portion of the inner tank after drawing the water from the lower portion of the inner tank and heating the drawn water. The pump means includes a body having a boiling chamber, heating means for heating the water in the boiling chamber and generating steam bubbles in the water, a first connecting pipe for guiding the water from the lower portion of the inner tank to the pump means body, a guide pipe in the body for feeding the water, guided through the first connecting pipe, into the boiling chamber and condensing the steam bubbles by the water fed through the guide pipe, a second connecting pipe for guiding the water heated in the boiling chamber into the upper portion of the inner tank, and first and second regulating means arranged in the first and second connecting pipes, for allowing the water to flow only from the lower portion of the inner tank toward the upper portion of the inner tank. The guide pipe is so arranged with respect to the pump means body that heat is exchanged between the water in the boiling chamber and the water flowing through the guide pipe.

With the hot water boiling apparatus thus constructed, when the water flow type heating means is put into action, water located at the bottom in the inner tank is guided into a connecting pipe of the heating means and heated to 80° C., for example, and goes up to the upper portion of the inner tank. Consequently, hot water of 80° C. gradually accumulates in a stratum and expands from top downward in the inner tank. When the operation of the heating means is stopped, the 80° C. hot water stratum is kept as it is in the inner tank, maintaining the temperature stratum property. The members connected from outside to the inner tank of the hot water storage tank are the water supply pipe, hot water supply pipe and connecting pipe only. For those pipes, the connected parts to the hot water storage tank can be limited to two by, for example, connecting the water supply pipe and a first connecting pipe with the inner tank in a common manner after the former and the lower end of the latter have been joined or, similarly, by connecting the hot water supply pipe and a second connecting pipe with the inner tank in a common manner after the former and the upper end of the latter have been joined. Therefore, the heat insulating function of the vacuum heat insulation space can be exercised to the fullest. As a result, it is possible to limit the heat loss through the outer tank of the hot water storage tank to a small enough value. Alternatively, by connecting those four pipes, i.e., the water supply pipe, first connecting pipe, hot water supply pipe, and second connecting pipe with the inner tank and by extending those pipes through the vacuum heat insulation space, it is possible to reduce the heat loss from those pipes and the connecting portions between those pipes and the inner tank. Also, when the heating means is put into action, hot water of 80° C. can be stored in the inner tank with the temperature stratum property maintained. Consequently, hot water of 80° C. suitable for use can be used in a short time from the moment the heating means is put into operation and thus response to demand can be improved.

BRIEF DESCRIPTION OF THE DRAWINGS

FIGS. 1 through 4B show a hot water boiling apparatus according to a first embodiment of this invention, in which FIG. 1 is sectional view showing the whole apparatus;

FIG. 2 is an enlarged sectional view of a bubble pump,

FIG. 3 is a view schematically showing a power supply system of the apparatus, and FIGS. 4A and 4B are views schematically showing different operating conditions of the bubble pump;

DETAILED DESCRIPTION OF THE PREFERRED EMBODIMENTS

With reference to the accompanying drawings, description will now be made in detail of hot water supply apparatuses according to embodiments of this invention.

Figure 1:
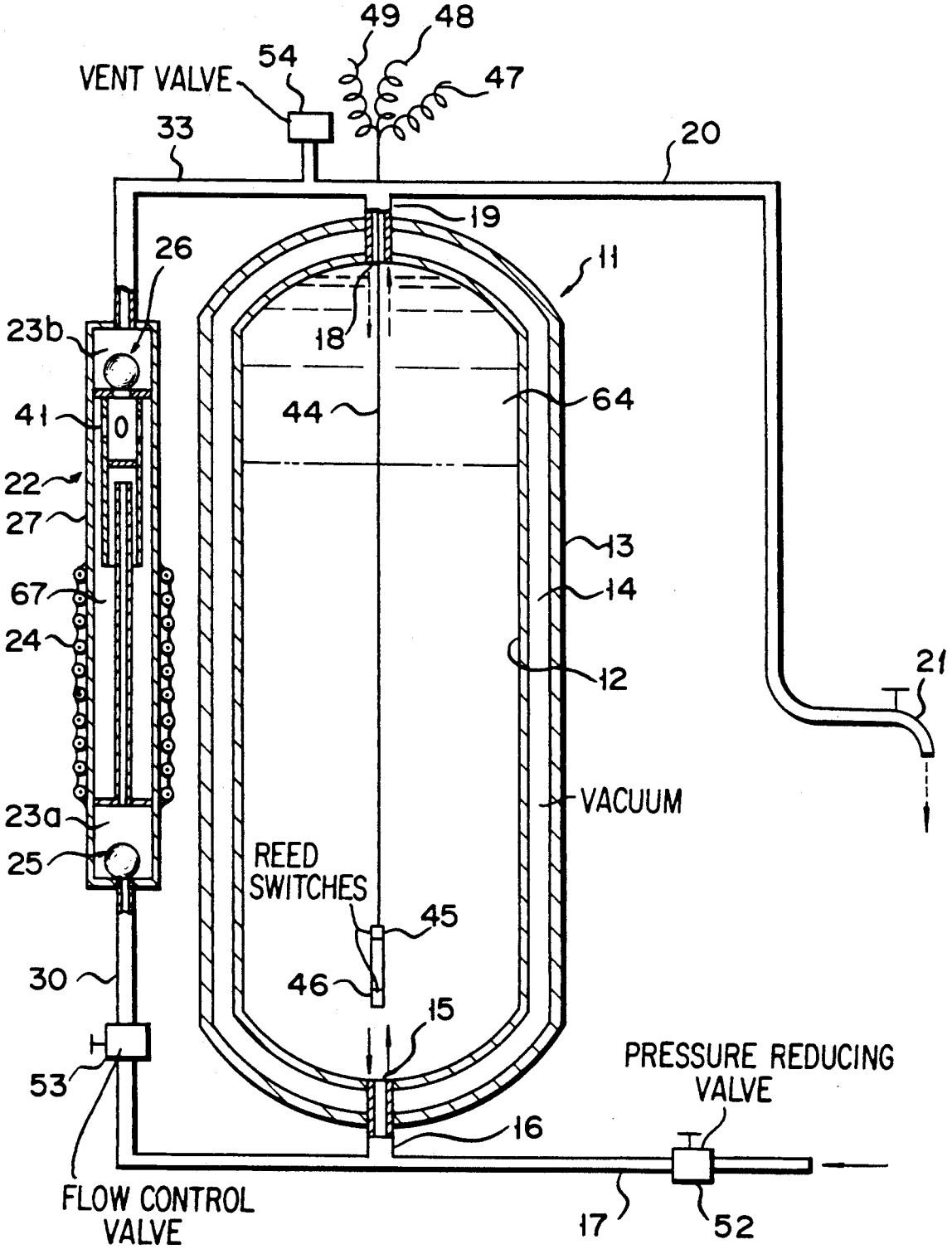

Referring to FIG. 1, a hot water boiling apparatus incorporates elongate hot water storage tank 11 extending in the vertical direction. Storage tank 11 comprises outer tank 13, inner tank 12 housed in the outer tank, and vacuum heat insulation space 14 which is defined between the inner and outer tanks and encloses the inner tank. Inner tank 12 and outer tank 13 are in a substantially cylindrical form with both ends closed, respectively.

Formed in the bottom wall of inner tank 12 is water supply port 15 through which water is supplied into and discharged from the inner tank. First pipe 16 is liquid-tightly connected at one end to this water supply port 15. Pipe 16 air-tightly passes through outer tank 13 and extends outside storage tank 11. Water supply pipe 17 is connected at one end to the other end of pipe 16. The opposite end of water supply pipe 17 is connected to a water source not shown, tap-water for example. Connected in series in the middle of water supply pipe 17 is pressure reducing valve 52 to reduce the pressure of water flowing through the water supply pipe into hot water storage tank 11 down to a level of 1 kg/cm$^2$ or below. Formed in the top wall of inner tank 12 is hot water supply port 18 through which hot water is discharged from and supplied into the inner tank. One end of second pipe 19 is liquid-tightly connected to hot water supply port 18. This pipe 19 air-tightly passes through outer tank 13 and extends outside storage tank 11. The opposite end of pipe 19 is connected through hot water supply pipe 20 to tap 21 located in the kitchen, bath room, and the like. Normally, inner tank 12 is always filled with water and is subjected to the pressure of water supplied through water supply pipe. Therefore, when tap 21 is opened, water in the hot water storage tank is led to the outside through hot water supply port 18, second pipe 19 and hot water supply pipe 20.

Figure 2:
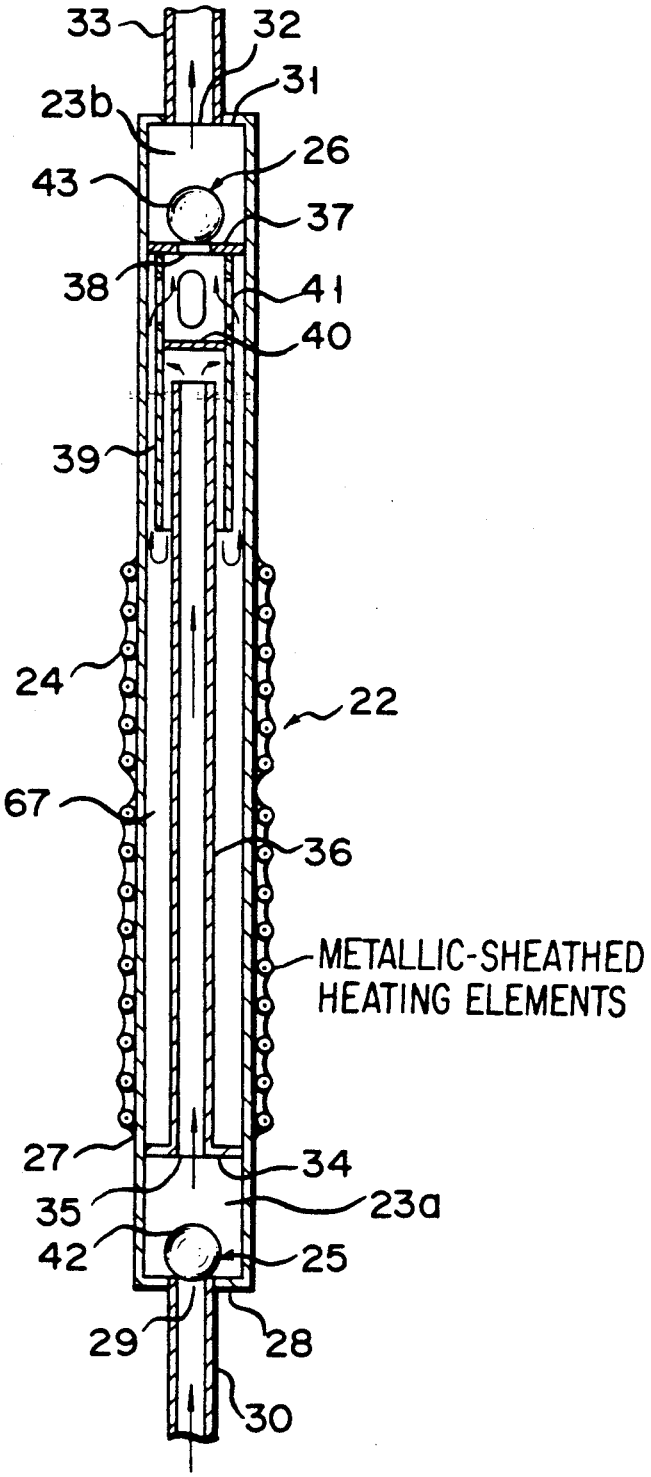

Bubble pump 22 is installed on the outside of hot water storage tank 11 and in parallel with the tank. As is shown in FIGS. 1 and 2, bubble pump 22 has pump body 27 located in the vertical direction. Pump body 27 in a cylindrical form is made of copper or aluminum. Upper and lower ends of pump body 27 are closed by upper and lower closing walls 31 and 28. Formed in lower wall 28 is inlet port 29, to which one end of first connecting pipe 30 is connected in a liquid-tight manner. The opposite end of connecting pipe 30 is connected to first pipe 16. Formed in upper wall 31 is outlet port 32, to which one end of second connecting pipe 33 is connected in a liquid-tight manner. The opposite end of connecting pipe 33 is connected to second pipe 19. Thus, hot water storage tank 11, first pipe 16, connecting pipe 30, pump body 27, and second connecting pipe 33 and pipe 19 constitute a closed-loop through which water flows.

In pump body 27, first and second partition plates 34 and 37 are arranged facing lower and upper closing walls 28 and 31, respectively. The inner space of pump body 27 is divided into lower valve chamber **23*a* defined between lower closing wall 28 and first partition plate 34, upper valve chamber 23*b* defined between upper closing wall 31 and second partition plate 37 and boiling chamber 67 defined between the first and second partition plates. In boiling chamber 67, first guide pipe 36 made of stainless steel, for example, is installed coaxially with pump body 27. The lower end of guide pipe 36 is liquid-tightly connected to through hole 35 formed in first partition plate 34. The upper end of guide pipe 36 extends close to second partition plate 37. Hence, water led from hot water storage tank 11 into lower valve chamber 23*a* through first connecting pipe 30 flows through guide pipe 36 and is supplied into boiling chamber 67 through an upper end opening or discharge port of the guide pipe. In boiling chamber 67, second guide pipe 39 made of stainless steel is installed coaxially with first guide pipe 36. Second guide pipe 39 has an outer diameter smaller than the inner diameter of pump body 27 and an inner diameter larger than the outer diameter of first guide pipe 36. The upper end of second guide pipe 39 is fixed to the underside of second partition plate 37 and communicates with through hole 38 formed in plate 37. The lower end of guide pipe 39 extends to a position where it laps over the upper end portion of guide pipe 36. In other words, the upper end of guide pipe 36 is inserted in the lower end portion of guide pipe 39. In second guide pipe 39, third partition plate 40 is secured and is opposed to the upper end of first guide pipe 36. A plurality of communicating bores 41 are formed in that portion of the peripheral wall of guide pipe 39 which is located between second and third partition plates 37 and 40. Water flowing out from the discharge port of first guide pipe 36 passes between the outer periphery of pipe 36 and the inner periphery of second guide pipe 39, and flows into boiling chamber 67. Water in the boiling chamber flows between the outer periphery of second guide pipe 39 and the inner periphery of pump body 27 and is guided into hot water storage tank 11 through communicating bores 41, through hole 38, upper valve chamber 23*a*, second connecting pipe 33 and second pipe 19**.

Check valves 25 and 26 are provided in lower and upper valve chambers **23*a*, 23*b*, respectively. Valve 25 is composed of a valve seat formed by the peripheral edge of through hole 29 and heat-resistant plastic ball 42 located in valve chamber 23*a* and cooperating with the valve seat. Valve 25 allows only the flow of water from first connecting pipe 30 toward pump body 27. Similarly, valve 26 is composed of a valve seat formed by the peripheral edge of through hole 38 and heat-resistant plastic ball 43 located in valve chamber 23*b* and cooperating with the valve seat. Valve 26 allows only the flow of water from pump body 27 to second connecting pipe 33**.

As heating means for heating water in boiling chamber 67, bubble pump 20 comprises sheath-type heater 24 with output of 2 kw, for example. Heater 24 is wound around that region of the outer periphery of pump body 27 between first partition plate 34 and the lower end of second guide pipe 39, and is secured by soldering.

Figure 3:
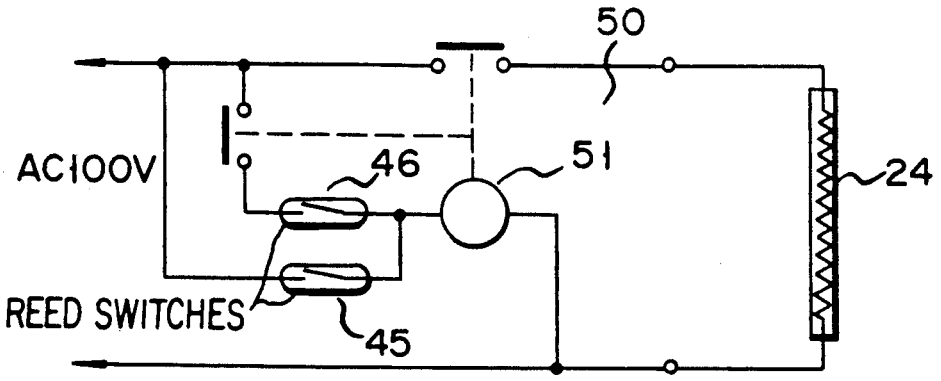

As is shown in FIG. 1, pipe 44 is inserted extending in the vertical direction in inner tank 12. The upper end portion of pipe 44 runs through second pipe 19, passes through the wall of second connecting pipe 33 in an airtight manner and extends outside. The lower end portion of pipe 44 extends to the vicinity of the bottom wall of inner tank 12. Thermal reed switches 45, 46 are fixed to the lower end portion of pipe 44, but they are separated in the vertical direction. Switches 45, 46 are constructed such that they maintain the ON state at temperatures below 60° C. and they maintain the OFF state at temperatures over 60° C. The terminals of switches 45, 46 are connected with lead wires 47, 48, 49. The lead wires are passed through pipe 44, led to the outside of hot water storage tank 11 and connected to power supply system 50 shown in FIG. 3. System 50 is constructed such that when switch 45 turns on as the quantity of hot water in inner tank 12 decreases, relay 51 is energized whereby power is supplied to heater 24 and relay 51 remains turned on. When the quantity of hot water increases to reach the level of switch 46, switch 46 turns off and power supply system 50 resets the self-holding state of relay 51, thus stopping the supply of power to heater 24.

In FIG. 1, numeral 53 indicates a flow control valve and numeral 54 indicates a vent valve.

Description will now be made of the operation of the hot water supply apparatus constructed as described above.

Let it first be supposed that inner tank 12 is filled with water at low temperature and tap 21 is closed. Under this condition, there is no water flow, so that check valves 25 and 26 are both closed and bubble pump 22 is filled with low-temperature water.

In this state, power supply system 50 is connected to a power source. Since thermal reed switches 45, 46 are in the ON state, relay 51 is energized. Thus, relay 51 comes to be in the self-holding state, and power begins to be supplied to electric heater 24.

Figure 4A:
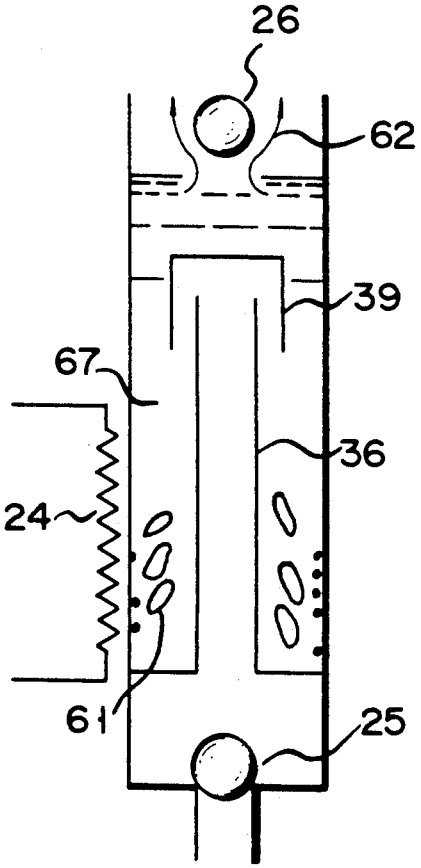
Figure 4B:
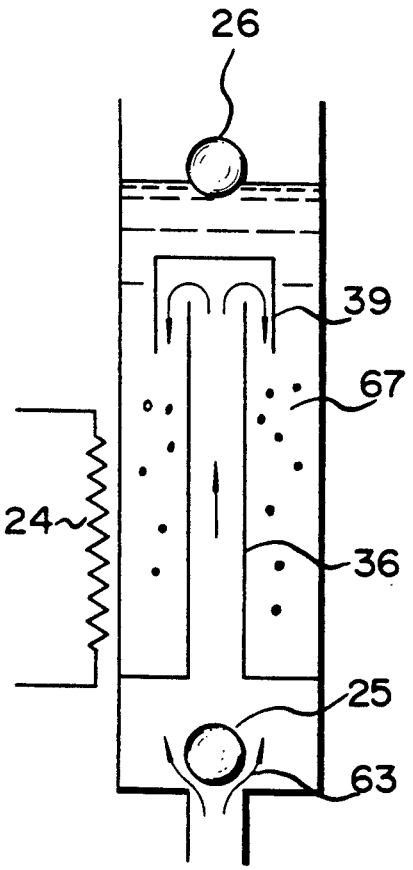

With the start of power supply to heater 24, water in contact with the inner periphery of pump body 27 is heated quickly. When part of the water in boiling chamber 67 reaches the boiling point, steam bubbles 61 are produced as is shown in FIG. 4A, thereby rapidly increasing the volume of water and raising the pressure in boiling chamber 67. As a result, check valve 26 is opened and hot water is fed from boiling chamber 67 to second connecting pipe 33 as is indicated by solid-line arrows 62 in FIG. 4A. When steam bubbles 61, rising by buoyancy, reach to the level of the lower end of second guide pipe 39, they are cooled and condensed by relatively cold water existing in the vicinity of the lower end of guide pipe 39. In consequence, the pressure in boiling chamber 67 is lowered. Then, as is shown in FIG. 4B, check valve 26 is closed and instead, check valve 26 is opened. As is indicated by solid-line arrows 63 in FIG. 4B, cold water existing in the lower region of inner tank 12 flows into boiling chamber 67 through first connecting pipe 30. By the inflow of cold water, the water temperature in boiling chamber 67 falls further and steam bubbles 61 disappear quickly. When bubbles 61 disappear, the inflow of water from pipe 30 stops. As a result, the water temperature in boiling chamber 67 shifts again to rising and steam bubbles 61 are produced again. the actions mentioned above are repeated hereafter. Therefore, hot water of e.g. 80° C. is intermittently sent out from boiling chamber 67.

The hot water of 80° C. thus sent out flows through second connecting pipe 33 and is fed through pipe 19 into the upper region in inner tank 12. Hence, hot water 64 of 80° C. accumulates in a stratum in inner tank 12 and this stratum of hot water gradually from top downward. When this stratum expands to the level of thermal reed switch 45, switch 45 turns to the OFF state. However, since switch 46 maintains the ON state, the power supply to electric heater 24 is continued. When the stratum of hot water further expands downward and reaches the level of switch 46, switch 46 turns OFF, causing the self-held state of relay 51 to be reset and the power supply to electric heater 24 is stopped.

Meanwhile, if hot water in inner tank 12 is used through tap 21, the thickness of the 80° C. hot water stratum in inner tank 12 decreases. When the quantity of the hot water decreases such that the lower end line of the hot water stratum rises above the position where thermal reed switch 45 is provided, switches 45 and 46 turn ON, thus supplying power to electric heater 24 again. Therefore, the quantity of hot water of 80°C. in the inner tank 12 is controlled so that the lower end line always exists between thermal reed switches 45 and 46.

As is described above, the elements connected from outside to inner tank 12 of hot water storage tank 11 are pipes 16 and 19 only. These pipes 16 and 19 may be small in diameter and heat loss due to the presence of pipes 16 and 19 are very small. Therefore, it is possible to make the diabatic function of vacuum heat insulation space 14 utilized to the fullest and restrict heat loss to a small value. In addition, when bubble pump 22 is put into operation, hot water of 80° C., suitable for use, can be stored in inner tank 12 with the temperature stratum property maintained. Hence, it is possible to use hot water of 80° C. in a short time from the moment bubble pump 22 is put into action. As is clear from the foregoing description, unlike with the natural convection heating method, even when pump 22 is put into operation while hot water of 80°C. remains in inner tank 12, neither the water in the inner tank is stirred nor the hot water temperature in the inner tank drops even temporarily.

Figure 5:
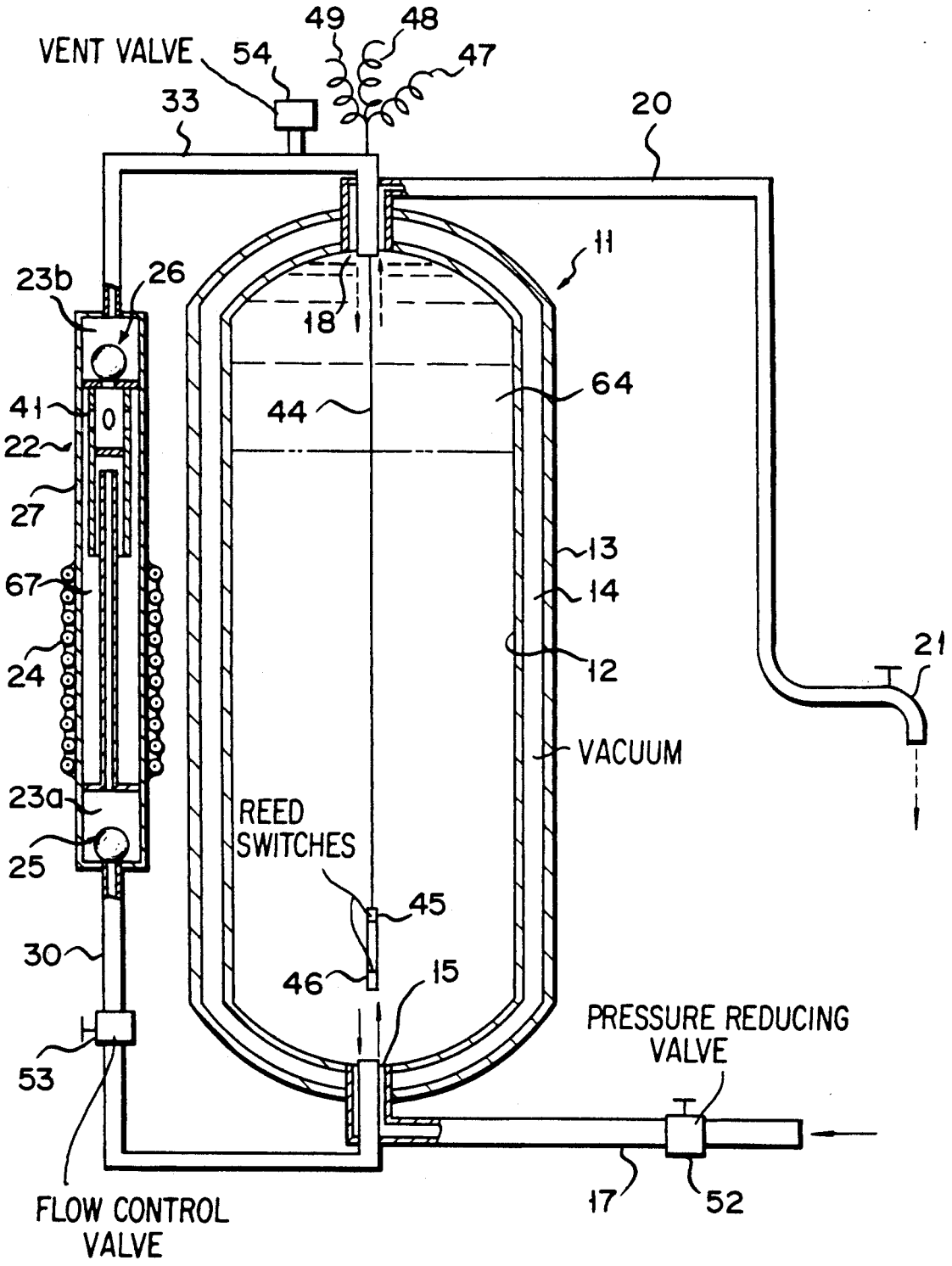
FIG 5 is a sectional view schematically showing a hot water boiling apparatus according to a second embodiment of this invention.

FIG. 5 schematically shows a hot water boiling apparatus according to a second embodiment of this invention. In FIG. 5, the parts, which are the same as in FIG. 1, are designated by corresponding numerals. Therefore, the parts which have been already been described will not be described here.

The aspects of this embodiment which differ from the first embodiment are the way in which water supply pipe 17 and first connecting pipe 30 are connected to inner tank 12 and the way in which hot water supply pipe 20 and second connecting pipe 33 are connected to inner tank 12.

To be more specific, the water supply end of pipe 17 air-tightly passes through the bottom wall of outer tank 13 and is connected to water supply port 15 in the bottom wall of inner tank 12. The lower end portion of first connecting pipe 30 air-tightly passes through the wall of pipe 17 and runs within pipe 17. Thus, both of water supply pipe 17 and first connecting pipe 30 communicate in a double pipe structure with the bottom part of inner tank 12. The inlet end of hot water supply pipe 20 air-tightly passes through the top wall of outer tank 13 and is connected to hot water supply port 18 in the top wall of inner tank 12. The upper end portion of second connecting pipe 33 air-tightly passes through the wall of pipe 20 and extends runs within pipe 20. Thus, pipes 20 and 33 communicate in a double pipe structure with the top part of inner tank 12. With the hot water boiling apparatus thus constructed, it is possible to obtain the same effects as in the first embodiment.

Figure 6:
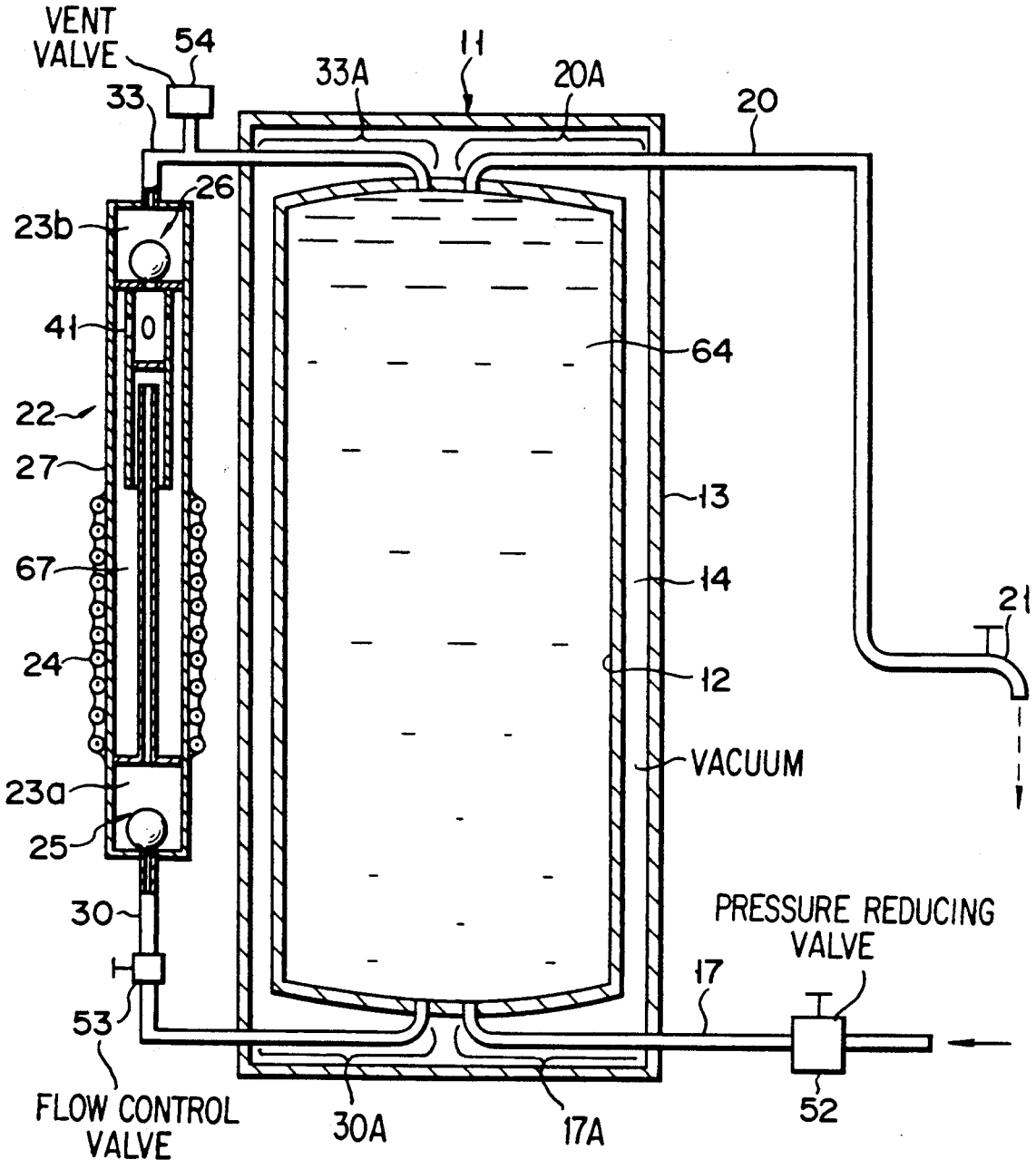
FIG. 6 is a sectional view similar to FIG. 5 but showing a third embodiment.

FIG. 6 schematically illustrates a hot water boiling apparatus according to a third embodiment of the present invention. In this figure, the same parts as those shown in FIG. 1 are designated by the same numerals. In the following description, the same parts will not be described in detail.

The third embodiment is different from the first embodiment (FIG. 1) in the specific way of connecting water supply pipe 17 and first connecting pipe 30 to inner tank 12, and also in the particular way of connecting hot water supply pipe 20 and second connecting pipe 33 to inner tank 12.

More specifically, pipes 17 and 30 pass, in air-tight fashion, through the lower side of water storage tank 11, further pass through vacuum heat-insulation space 14, and are connected, in liquid-tight fashion, to the bottom of inner tank 12. Pipes 20 and 33 pass, in air-tight fashion, through the upper side of water storage tank 11, further pass through the vacuum heat-insulation layer, and are connected, in liquid-tight fashion, to the top of inner tank 12.

The embodiment shown in FIG. 6, therefore, have four pipes which are connected to inner tank 12. Nonetheless, the heat loss at the positions where these pipes are connected to inner tank 12 is negligibly small since these pipes have insulation portions 17A, 20A, 30A and 33A which extend substantially horizontally and pass through the vacuum heat-insulation space, and are connected to tank 12 within the envelope defined by vacuum heat-insulation space 14.

Moreover, since water supply pipe 17, first connecting pipe 30, hot water supply pipe 20, and second connecting pipe 33 pass through the side wall of outer tank 13, the bottom wall of tank 13 can be made flat, and the hot water boiling apparatus can thus be put on the floor. This will be greatly advantageous when the hot water boiling apparatus is made small for use in a kitchen.

In the first embodiment (FIG. 1), and also in the second embodiment (FIG. 5), which have two pipes connected to inner tank 12, water supply pipe 17, first connecting pipe 30, hot water supply pipe 20, and second connecting pipe 33 can be connected to inner tank 12 at positions within an envelope defined by a vacuum heat-insulation space and can pass through outer tank 13 in air-tight fashion. Also in this case, the bottom of tank 13 will be flat only if water supply pipe 17 and first connecting pipe 30 pass, in airtight fashion, through the side wall of tank 13.

This invention is not limited to the above embodiments but may be embodied in various forms within the scope of this invention.

Figure 7:
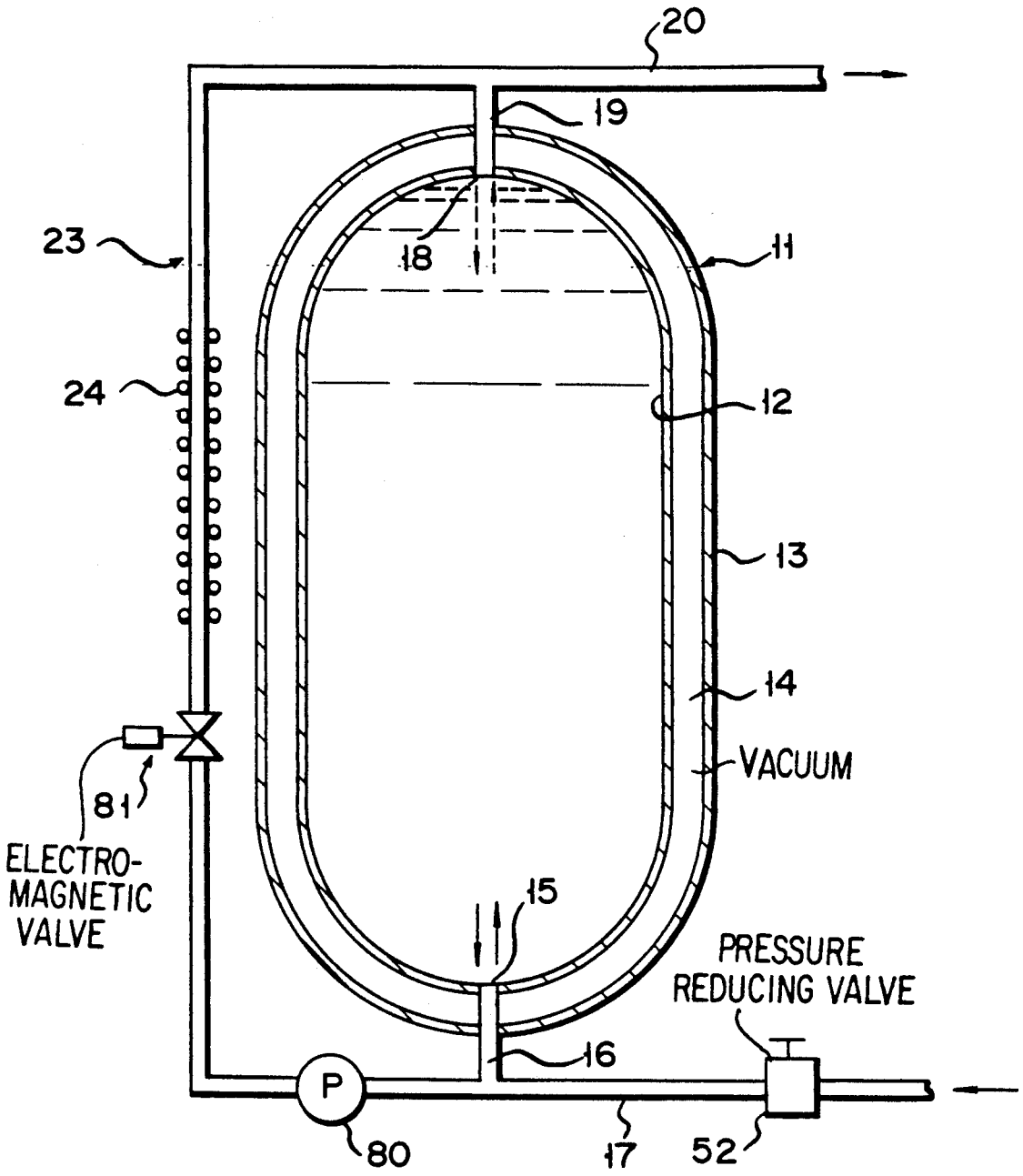
FIG. 7 is similar to FIG. 5 but shows a fourth embodiment.

In the above embodiments, a bubble pump is used as the water flow type heating means but the heating means is not limited to such an application. For example, the heating means may be constructed as is indicated in FIG. 7. The heating means comprises connecting pipe 23 which has one end connected to first pipe 16 and the other end connected to second pipe 19, and which forms a closed loop of water flow jointly with hot water storage tank 11. Electric heater 24 is wound around the outer periphery of the middle portion of connecting pipe 23. Pump 80 is connected to pipe 23 between first pipe 16 and heater 24. This pump draws water at the bottom part of inner tank 12 through water supply port 15 into connecting pipe 23 and again supplies inner tank 12 with the water through hot water supply port 18. Electromagnetic valve 81 is provided between pump 80 and heater 24 of pipe 23. With heater 24 and pump 80 kept in operation, by intermittently opening and closing valve 81, water heated by heater 24 to a desired temperature is supplied through hot water supply port 18 into inner tank 12.

Figure 8:
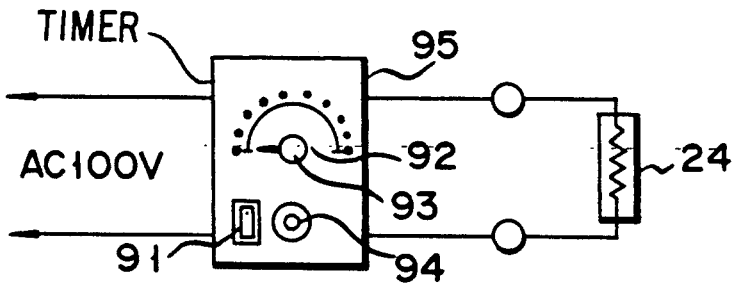
FIG. 8 is a view showing a modification of the power supply system.

The power supply system is not limited to such a construction in which the quantity of hot water is controlled to a fixed level in inner tank 12 but may be constructed as is shown in FIG. 8. This power supply system 50 is constructed such that power is supplied to heater 24 for a period of time set with timer switch 92 by pushing push button 94 after manual switch 91 is turned on and a desired period of time is set by rotating knob 93 of timer switch 92.

What is claimed is:

1. A hot water boiling apparatus comprising:

a hot water storage tank including an inner tank adapted to store water therein and having a top wall, and an outer tank enclosing the inner tank, and a vacuum heat insulation space defined between the inner and outer tanks and substantially completely surrounding the inner tank;

a hot water supply pipe for guiding the water from an upper portion of the inner tank to the outside of the hot water tank, said supply pipe having an end portion connected to the top wall of the inner tank and passing through the vacuum insulation space and the outer tank air-tightly, said supply pipe having an insulation portion located in the vacuum insulation space and extending substantially horizontally through the vacuum space to the outer tank;

water supply means for supplying a lower portion of the inner tank with water; and flow-type water heating means arranged external of the water storage tank in flow communication with the water storage tank, for drawing the stored water from the lower portion of the inner tank and, after heating the water, returning the heated water into the upper portion of the inner tank, said heating means including a connecting pipe which introduces the heated water into the inner tank and has an end portion connected to the top wall of the inner tank and passing through the insulation space and the outer tank air-tightly, said connecting pipe having an insulation portion located in the vacuum insulation space and extending substantially horizontally through the vacuum space to the outer tank.

2. An apparatus according to claim 1, wherein said outer tank includes an top wall facing the top wall of the inner tank and a side wall substantially extending vertically, and said insulation portions of the connecting pipe and hot water supply pipe passing through the side wall of the outer tank.

3. An apparatus according to claim 1, wherein said connecting pipe has a second end portion connected to the lower portion of the inner tank and passing through the insulation space and the outer tank air-tightly, and said heating means includes bubble pump means which comprises a boiling chamber defined in the connecting pipe, a heater for heating water in the boiling chamber and generating steam bubbles in the water, and guide means associated with said boiling chamber for feeding the water, introduced through the second end portion of the connecting pipe, into the boiling chamber and condensing the steam bubbles by the water fed through the guide means.

4. A hot water boiling apparatus comprising: a hot water storage tank including an inner tank adapted to store water therein, and an outer tank enclosing the inner tank, and a vacuum heat insulation space defined between the inner and outer tanks and surrounding the inner tank;

a hot water supply pipe for guiding the water from an upper portion of the inner tank to the outside of the hot water tank;

water supply means for supplying a lower portion of the inner tank with water; and bubble pump means arranged external of said hot water storage tank, for feeding hot water into the upper portion of the inner tank after drawing the water from the lower portion of the inner tank and heating the drawn water, said pump means including a body having a boiling chamber, heating means for heating water in the boiling chamber and generating steam bubbles in the water, a first connecting pipe for guiding the water from the lower portion of the inner tank to the pump means body, a guide pipe in said body for feeding the water, guided through the first connecting pipe, into the boiling chamber and condensing the steam bubbles by the water fed through the guide pipe, a second connecting pipe for guiding the water heated in the boiling chamber into the upper portion of the inner tank, and first and second regulating means arranged in the first and second connecting pipes, for allowing the water to flow only from the lower portion of the inner tank toward the upper portion of the inner tank, said guide pipe being so arranged with respect to said pump means body that heat is exchanged between the water in the boiling chamber and the water flowing through the guide pipe.

5. An apparatus according to claim 4, wherein said water supply means includes a water supply pipe with one end communicating with the lower portion of the inner tank, one of an end of the first connecting pipe and said one end of the water supply pipe air-tightly passing through the vacuum insulation space and the outer tank and being liquid-tightly connected to the lower portion of the inner tank, the other running within said one of the two pipes and communicating with the lower portion of the inner tank; said hot water supply pipe communicating at one end with the upper portion of the inner tank, one of an end of the second connecting pipe and said one end of the hot water supply pipe air-tightly passing through the outer tank and being liquid-tightly connected to the upper portion of the inner tank, the other running within said one of latter two pipes and communicating with the upper portion of the inner tank.

6. An apparatus according to claim 4, wherein said heating means comprising an electric heater and includes a sensor for detecting the temperature of water in the inner tank and a power supply system for controlling power supply to the electric heater in response to a detection signal from the sensor.

7. An apparatus according to claim 6, wherein said sensor is electrical, is provided in the lower portion in the inner tank and is electrically connected to said power supply system through a lead wire extending through the second connecting pipe to the outside of the hot water storage tank.

* * * * *